US011548292B2

(12) United States Patent
Ohara

(10) Patent No.: US 11,548,292 B2
(45) Date of Patent: Jan. 10, 2023

(54) PRINTING APPARATUS AND PRINTING METHOD

(71) Applicant: SEIKO EPSON CORPORATION, Tokyo (JP)

(72) Inventor: Eiichi Ohara, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/388,055

(22) Filed: Jul. 29, 2021

(65) Prior Publication Data

US 2022/0032647 A1 Feb. 3, 2022

(30) Foreign Application Priority Data

Jul. 31, 2020 (JP) ..... JP2020-130102

(51) Int. Cl.
*B41J 2/21* (2006.01)
*B41J 29/393* (2006.01)

(52) U.S. Cl.
CPC ..... *B41J 2/2142* (2013.01); *B41J 29/393* (2013.01); *B41J 2029/3935* (2013.01)

(58) Field of Classification Search
CPC ... B41J 2/21; B41J 29/393; B41J 29/38; B41J 2029/3935; B41J 2/2132; B41J 2/2142; B41J 2/04558
See application file for complete search history.

(56) References Cited

U.S. PATENT DOCUMENTS

2007/0040878 A1 2/2007 Ikefuji et al.
2008/0079762 A1* 4/2008 Yoshida ..... B41J 29/38 347/16
2010/0245428 A1* 9/2010 Kitahara ..... B41J 29/393 347/12

FOREIGN PATENT DOCUMENTS

JP 2007-054970 A 3/2007
JP 2016-198899 A 12/2016
JP 2016-221835 A 12/2016

* cited by examiner

*Primary Examiner* — Jannelle M Lebron
(74) *Attorney, Agent, or Firm* — Global IP Counselors, LLP

(57) ABSTRACT

A main TP is formed by N pattern element groups formed of a plurality of pattern elements disposed in cycles of N in a first direction, and disposed in positions shifted with respect to each other in a second direction intersecting the first direction. A first sub TP is configured by pattern elements printed by the nozzles used to print the pattern elements of the pattern element group positioned furthest away from the one region, in the second direction, among the N pattern element groups, and a second sub TP is configured by pattern elements printed by the nozzles used to print the pattern elements of the pattern element group positioned furthest away from the other region, in the second direction, among the N pattern element groups.

3 Claims, 10 Drawing Sheets

PRINTING APPARATUS AND PRINTING METHOD

The present application is based on, and claims priority from JP Application Serial Number 2020-130102, filed Jul. 31, 2020, the disclosure of which is hereby incorporated by reference herein in its entirety.

BACKGROUND

1. Technical Field

The present disclosure relates to a printing apparatus and a printing method.

2. Related Art

Technology has been disclosed of an inkjet type printing apparatus in which a test pattern is recorded on a print sheet by a recording head, the test pattern is read by a scanner, interpolation processing is performed on read data, and a nozzle abnormality is determined on the basis of the interpolated read data (see JP-A-2007-54970).

In FIG. 3 of JP-A-2007-54970, a step-wise test pattern is disclosed in which a line printed using each nozzle of a recording head as a unit is one row pattern formed by lines in cycles of eight, and the adjacent row patterns are arranged so as to be shifted with respect to each other in a direction orthogonal to a direction in which the nozzles are arranged. By printing the lines of each of the nozzles so as to be shifted in the stepwise manner in this way, each of the lines is easily distinguished and visually recognized.

However, when a scanner reads a printing medium on which the test pattern is printed, the printing medium may become tilted. In read data obtained by reading the tilted printing medium, with respect to an interval between the lines, the larger the shift amount between the lines, which determines the interval between the lines, the more the interval becomes significantly too large or, in contrast, becomes too narrow. Thus, it may be difficult to detect the original interval between the printed lines from the read data and, as a result, it is difficult to maintain inspection accuracy as to whether the nozzle is normal or not. Therefore, there is a need for a test pattern with which a nozzle inspection is appropriately performed even when the test pattern is read in the tilted state.

SUMMARY

A printing apparatus includes a printing head including a plurality of nozzles configured to discharge ink, and a control unit configured to control the printing head to print, on a printing medium, a test pattern for inspecting a state of ink discharge by the nozzles. N is an integer of 3 or greater, and the test pattern includes a main test pattern in which a plurality of pattern elements printed by the nozzles are arranged in a first direction, the main test pattern being formed by N pattern element groups, the main test pattern including the pattern element groups disposed in positions shifted with respect to each other in a second direction intersecting the first direction, the pattern element groups being formed of the plurality of pattern elements disposed in cycles of N in the first direction. The test pattern includes at least one of a first sub test pattern and a second sub test pattern, the first sub test pattern being disposed in one of two regions sandwiching the main test pattern in the second direction, and the second sub test pattern being disposed in the other of the two regions. The first sub test pattern is configured by pattern elements printed by the nozzles used to print the pattern elements of the pattern element group positioned furthest away from the one region, in the second direction, among the N pattern element groups, and the second sub test pattern is configured by pattern elements printed by the nozzles used to print the pattern elements of the pattern element group positioned furthest away from the other region, in the second direction, among the N pattern element groups.

A printing method includes a printing step of controlling a printing head including a plurality of nozzles configured to discharge ink, to print, on a printing medium, a test pattern for inspecting a state of ink discharge by the nozzles. N is an integer of 3 or greater, and the test pattern includes a main test pattern in which a plurality of pattern elements printed by the nozzles are arranged in a first direction, the main test pattern being formed by N pattern element groups, the main test pattern including the pattern element groups disposed in positions shifted with respect to each other in a second direction intersecting the first direction, the pattern element groups being formed of the plurality of pattern elements disposed in cycles of N in the first direction. The test pattern includes at least one of a first sub test pattern and a second sub test pattern, the first sub test pattern being disposed in one of two regions sandwiching the main test pattern in the second direction, and the second sub test pattern being disposed in the other of the two regions. The first sub test pattern is configured by pattern elements printed by the nozzles used to print the pattern elements of the pattern element group positioned furthest away from the one region, in the second direction, among the N pattern element groups, and the second sub test pattern is configured by pattern elements printed by the nozzles used to print the pattern elements of the pattern element group positioned furthest away from the other region, in the second direction, among the N pattern element groups.

DESCRIPTION OF EXEMPLARY EMBODIMENTS

Embodiments of the present disclosure will be described below with reference to the accompanying drawings. Note that each of the drawings is merely illustrative for describing the embodiment. Since the drawings are illustrative, proportions and shapes may not be precise, match each other, or some may be omitted.

1. Apparatus Configuration

Figure 1:
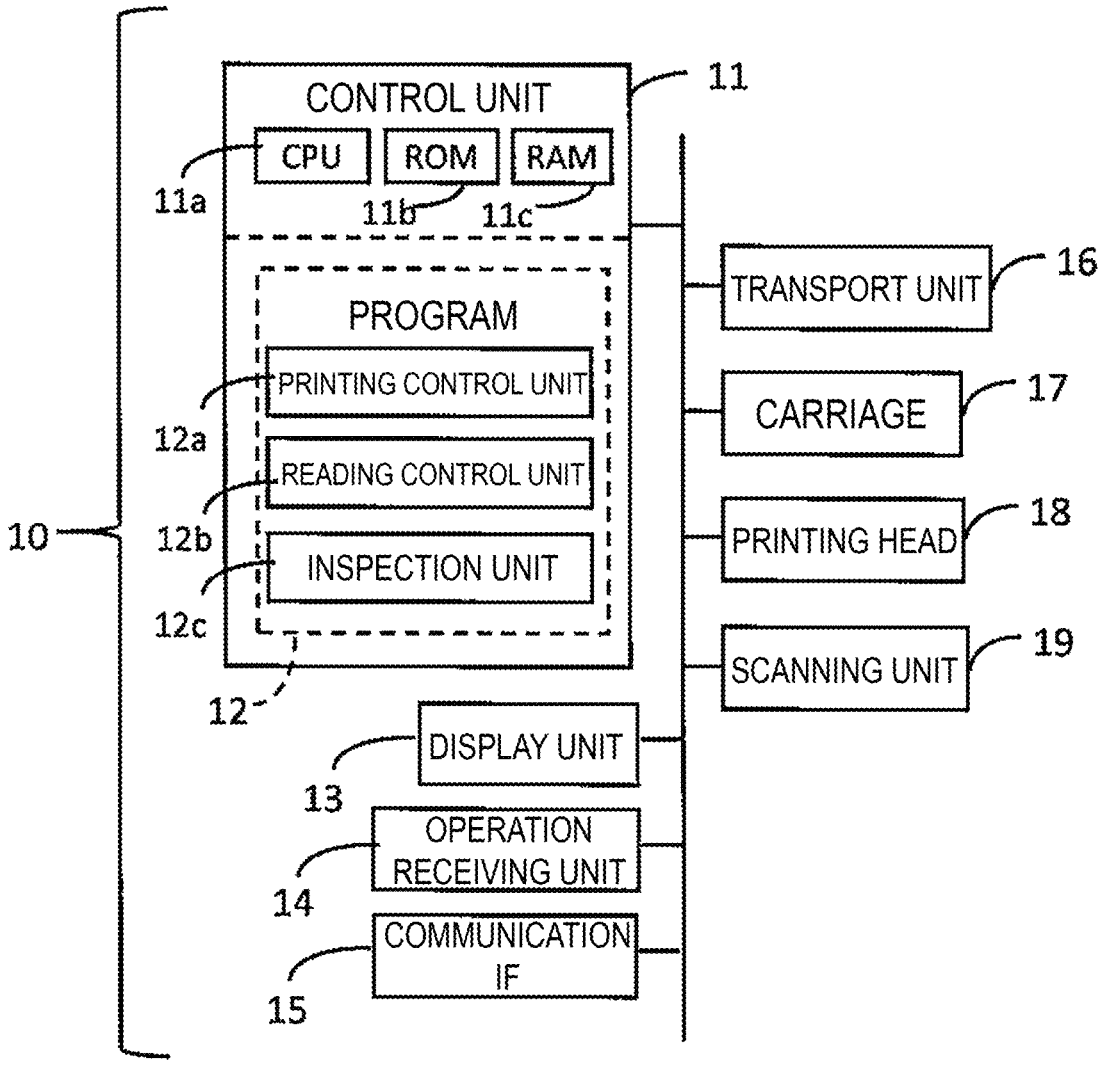
FIG. 1 is a block diagram illustrating an apparatus configuration in a simplified manner.

FIG. 1 illustrates a configuration of a printing apparatus 10 according to the embodiment, in a simplified manner.

The printing apparatus 10 is provided with a control unit 11, a display unit 13, an operation receiving unit 14, a communication IF 15, a transport unit 16, a carriage 17, a printing head 18, a reading unit 19, and the like. IF is an abbreviation for interface. The control unit 11 is configured to include one or more ICs including a CPU 11*a* as a processor, a ROM 11*b*, a RAM 11*c*, and the like, another non-volatile memory, and the like.

In the control unit 11, the processor, that is, the CPU 11*a* executes arithmetic processing in accordance with one or more programs 12 stored in the ROM 11*b*, the other memory, or the like, using the RAM 11*c* or the like as a work area, to realize various functions such as a printing control unit 12*a*, a reading control unit 12*b*, an inspection unit 12*c*, and the like. Note that the processor is not limited to the single CPU, and a configuration may be adopted in which the processing is performed by a hardware circuit such as a plurality of CPUs, an ASIC, or the like, or a configuration may be adopted in which the CPU and the hardware circuit work in concert to perform the processing.

The display unit 13 is a device for displaying visual information, and is configured, for example, by a liquid crystal display, an organic EL display, or the like. The display unit 13 may be configured to include a display and a drive circuit for driving the display. The operation receiving unit 14 is a device for receiving an operation by a user, and is realized, for example, by a physical button, a touch panel, a mouse, a keyboard, or the like. Of course, the touch panel may be realized as a function of the display unit 13.

The display unit 13 and the operation receiving unit 14 may be part of the configuration of the printing apparatus 10, or may be peripheral devices externally coupled to the printing apparatus 10. The communication IF 15 is a generic term for one or a plurality of IFs for coupling the printing apparatus 10 with the outside in a wired or wireless manner, in accordance with a prescribed communication protocol including a known communication standard provide.

The transport unit 16 is a device for transporting the printing medium, and includes a roller, a motor for rotating the roller, and the like. The printing head 18 discharges ink from nozzles onto the printing medium, using an inkjet method, to perform printing. The reading unit 19 is a device for reading a printing result on the printing medium. The reading unit 19 is also referred to as a scanner. However, the printing apparatus 10 may have a configuration that does not include the reading unit 19.

Figure 2:
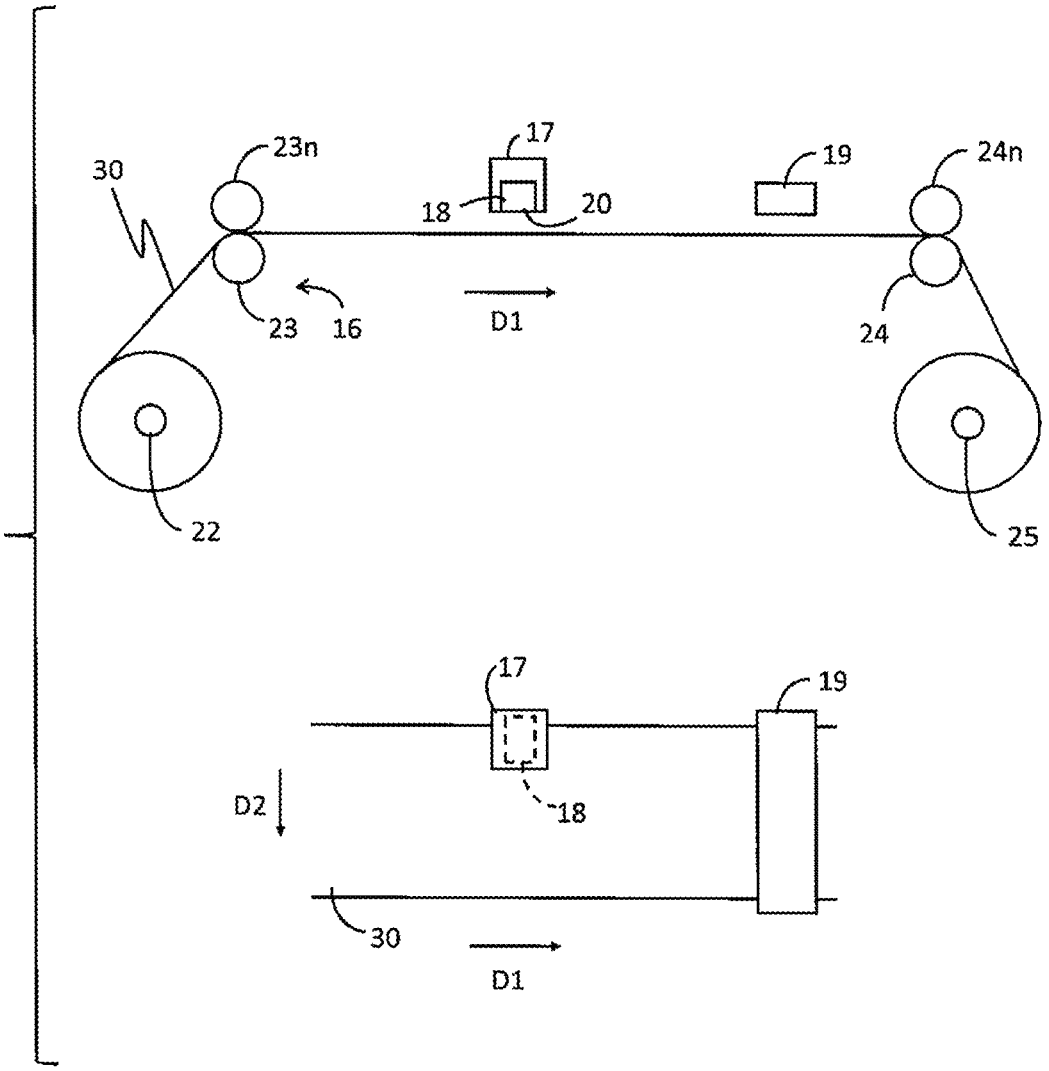
FIG. 2 is a diagram illustrating a specific example of a configuration including a printing head and a transport unit.
Figure 3:
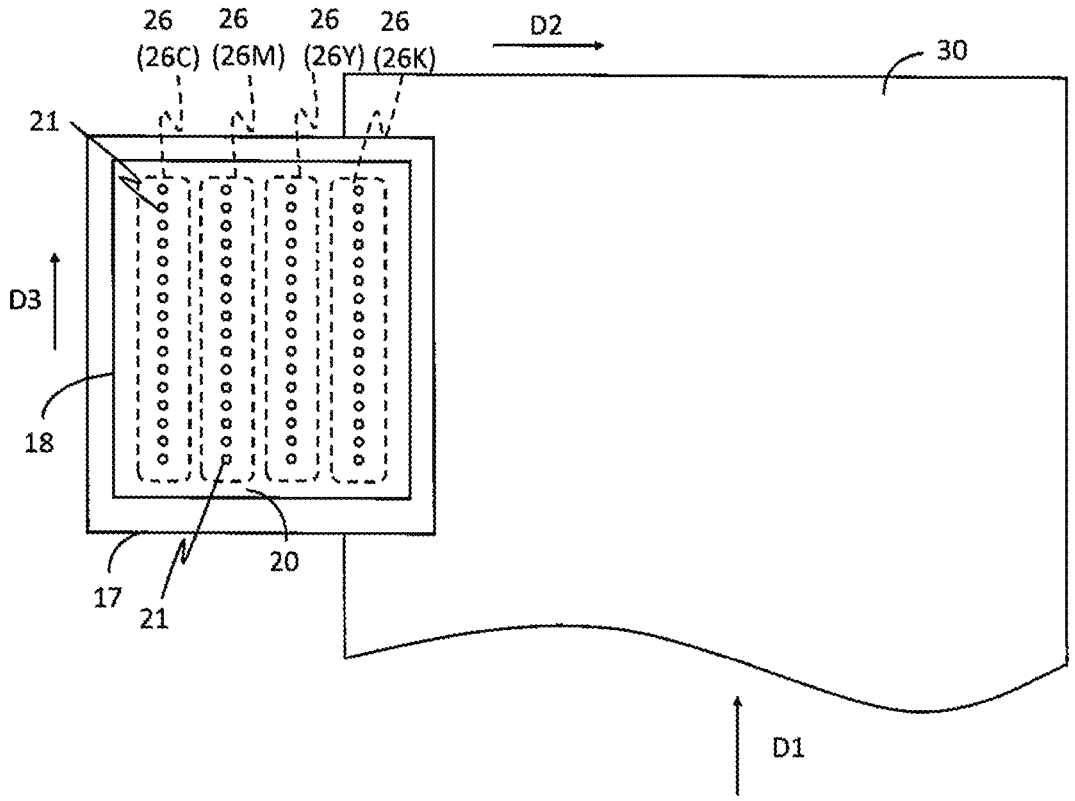
FIG. 3 is a diagram illustrating a relationship between a printing medium and the printing head, as seen from above.

The carriage 17 is a mechanism capable of reciprocating along a predetermined direction as a result of receiving power from a carriage motor (not illustrated). The predetermined direction in which the carriage 17 moves is referred to as a main scanning direction. As illustrated in FIG. 2 and FIG. 3, the printing head 18 is mounted on the carriage 17.

The configuration of the printing apparatus 10 illustrated in FIG. 1 may be realized by a single printer, or may be realized by a plurality of communicatively coupled devices.

In other words, the printing apparatus 10 may be the printing system 10 in actuality. The printing system 10 includes, for example, an information processing device that functions as the control unit 11, and a printer including the transport unit 16, the carriage 17, the printing head 18, and further, the reading unit 19. A printing method according to the embodiment is realized in this way by the printing apparatus 10 or the printing system 10.

Further, a portion of the control unit 11 that functions as the printing control unit 12*a* and a portion of the control unit 11 that functions as the reading control unit 12*b* and the inspection unit 12*c* may be separate information processing devices.

FIG. 2 illustrates a specific example of a configuration mainly including the printing head 18 and the transport unit 16, which are parts of the printing apparatus 10. In an upper section of FIG. 2, the specific example is illustrated as viewed in a direction orthogonal to a transport direction D1 of a printing medium 30, and, in a lower section of FIG. 2, the specific example is illustrated as viewed from above.

The transport unit 16 is provided with a feeding shaft 22 upstream in the transport direction, and a winding shaft 25 downstream in the transport direction. Upstream and downstream in the transport direction are simply denoted using upstream and downstream. The long printing medium 30 wound in a roll shape around the feeding shaft 22 and the winding shaft 25 is stretched along the transport direction D1. The printing medium 30 is transported in the transport direction D1. The printing medium 30 may be a paper sheet or may be a medium made from a material other than paper.

In the example illustrated in FIG. 2, the printing medium 30 wound around the feeding shaft 22 is fed downstream by the feeding shaft 22 rotating in the clockwise direction. A front driving roller 23 is provided at a position downstream of the feeding shaft 22, and a rear driving roller 24 is provided at a position upstream of the winding shaft 25. By rotating in the clockwise direction, the front driving roller 23 transports downstream the printing medium 30 fed out from the feeding unit 22. A nip roller 23*n* is provided with respect to the front driving roller 23. The nip roller 23*n* comes into contact with the printing medium 30 so as to clamp the printing medium 30 between the nip roller 23*n* and the front driving roller 23.

By rotating in the clockwise direction, the rear driving roller 24 transports further downstream the printing medium 30 transported downstream by the front driving roller 23. Note that a nip roller 24*n* is provided with respect to the rear driving roller 24. The nip roller 24*n* comes into contact with the printing medium 30 so as to clamp the printing medium 30 between the nip roller 24*n* and the rear driving roller 24.

The printing head 18 that discharges ink onto the printing medium 30 from above is disposed between the front driving roller 23 and the rear driving roller 24. As illustrated in FIG. 2, the printing head 18 is mounted on the carriage 17. The printing head 18 is capable of discharging a plurality of colors of ink, such as cyan (C), magenta (M), yellow (Y), and black (K), for example.

Each of the nozzles of the printing head 18 is open in a nozzle surface 20, of the printing head 18, facing the printing medium 30, and the printing head 18 discharges or does not discharge the ink from the nozzles on the basis of print data. The ink discharged by the nozzle is also referred to as an ink droplet, or as a dot. The printing head 18 may also be referred to as a print head, an inkjet head, a liquid discharging head, a recording head, and the like.

As a result of the winding shaft 25 rotating in the clockwise direction, the winding shaft 25 takes up the printing medium 30 after printing that is transported by the rear driving roller 24.

The feeding shaft 22, the winding shaft 25, each of the rollers, the motor (not illustrated) for rotating these members as appropriate, and the like are a specific example of the transport unit 16 that transports the printing medium 30. A number and arrangement of the rollers provided along the transport path for transporting the printing medium 30 is not limited to the mode illustrated in FIG. 2. Further, the colors of the inks discharged by the printing head 18 are not limited to the colors described above. It goes without saying that a flat platen or the like, which supports, from below, the printing medium 30 that receives the ink discharge from the printing head 18, may be provided between the front driving roller 23 and the rear driving roller 24. Further, the portion of the printing medium 30 on which the printing by the printing head 18 has been performed need not necessarily be wound into the roll shape by the winding shaft 25, and may be cut away from the printing medium 30 that is upstream of the printed portion, using a cutter (not illustrated).

In the example illustrated in FIG. 2, the reading unit 19 is provided at a position downstream of the carriage 17 and the printing head 18 and upstream of the rear driving roller 24. Using an image sensor, the reading unit 19 optically reads the printing medium 30 on which the printing has been performed by the printing head 18, and outputs image data as a reading result. In the example illustrated in FIG. 2, the reading unit 19 extends in a main scanning direction D2 that intersects the transport direction D1 and has a length capable of covering the width of the printing medium 30, and reads the printing medium 30 transported by the transport unit 16 in a stationary state.

FIG. 3 illustrates a relationship between the printing medium 30 and the printing head 18 in a simplified manner, as seen from above. The printing head 18 mounted on the carriage 17 moves, together with the carriage 17, from one end in the main scanning direction D2 to the other end (a forward movement) and from the other end to the one end (a return movement). The main scanning direction D2 and the transport direction D1 intersect each other. The intersection may be understood to be orthogonal. Thus, FIG. 2 illustrates the printing head 18 and the like from a perspective facing in parallel to the main scanning direction D2. However, due to various errors in the printer as a manufactured product, for example, the main scanning direction D2 and the transport direction D1 may not be precisely orthogonal. The transport direction is also referred to as a sub scanning direction.

In FIG. 3, an example is illustrated of an array of nozzles 21 in the nozzle surface 20. Each of small circles in the nozzle surface 20 is the nozzle 21. The printing head 18 is provided with a plurality of nozzle rows 26 in a configuration in which each color of the inks is discharged from the nozzles 21 after being supplied from a liquid holding unit (not illustrated) that is referred to as an ink cartridge, an ink tank, or the like. The nozzle row 26 including the nozzles 21 that discharge the C ink is also described as a nozzle row 26C. Similarly, the nozzle row 26 including the nozzles 21 that discharge the M ink is also described as a nozzle row 26M, the nozzle row 26 including the nozzles 21 that discharge the Y ink is also described as a nozzle row 26Y, and the nozzle row 26 including the nozzles 21 that discharge the K ink is also described as a nozzle row 26K. The nozzle rows 26C, 26M, 26Y, and 26K are aligned along the main scanning direction D2.

Each of the nozzle rows 26 is configured by the plurality of nozzles 21 for which a nozzle pitch, which is an interval between the nozzles 21 in the transport direction D1, is constant or substantially constant. The direction in which the plurality of nozzles 21 configuring the nozzle row 26 are aligned is referred to as a nozzle row direction D3. In the example illustrated in FIG. 3, the nozzle row direction D3 is parallel with the transport direction D1. In the configuration in which the nozzle row direction D3 is parallel with the transport direction D1, the nozzle row direction D3 and the main scanning direction D2 are orthogonal. However, the nozzle row direction D3 need not necessarily be parallel with the transport direction D1, and a configuration may be adopted in which the nozzle row direction D3 obliquely intersects the main scanning direction D2.

The respective positions of the nozzle rows 26C, 26M, 26Y, and 26K in the transport direction D1 match each other. The printing apparatus 10 prints an image on the printing medium 30 by performing a combination of transport of the printing medium 30 in the transport direction D1, and ink discharge by the printing head 18 in accordance with movement of the carriage 17 along the main scanning direction D2. The operation of the ink discharge by the printing head 18 in accordance with the forward movement and the return movement of the carriage 17 is referred to as a "scan" or a "pass".

2. Test Pattern Printing

Figure 4:
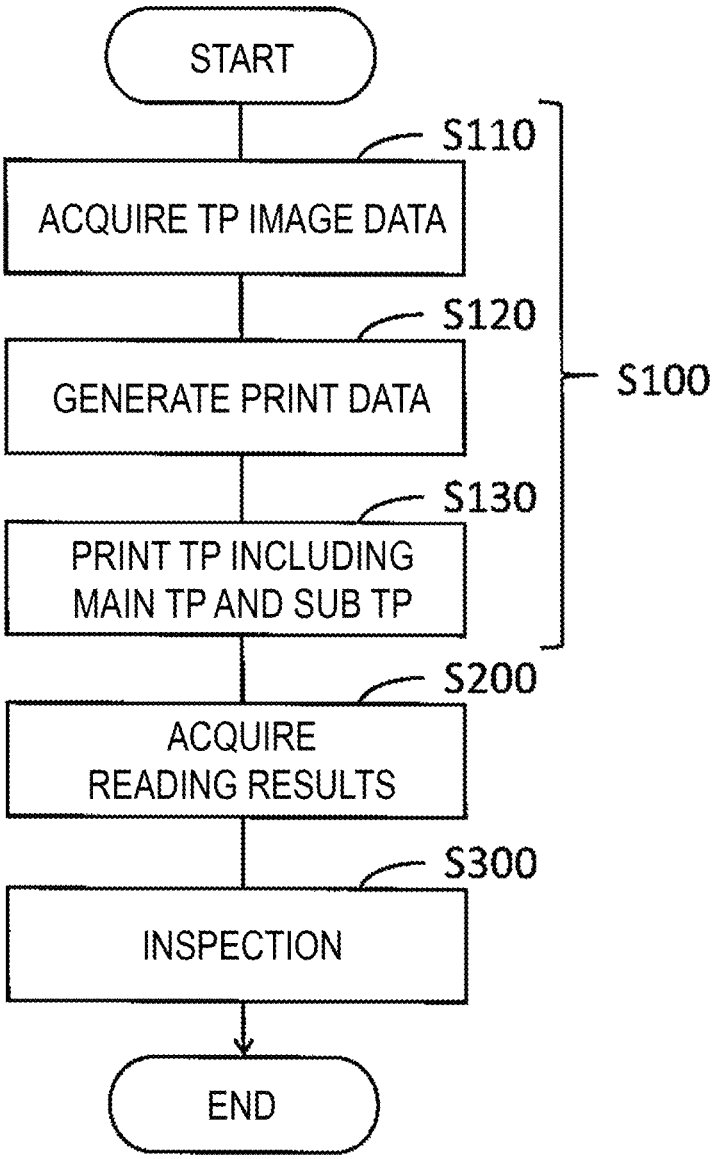
FIG. 4 is a flowchart illustrating a flow from TP printing to an inspection of nozzles.

FIG. 4 illustrates, using a flowchart, a flow executed by the control unit 11 in accordance with the program 12, from printing of a TP to an inspection of the nozzles 21 on the basis of the TP. TP is an abbreviation for test pattern. In overview, the flowchart includes TP printing processing (step S100), acquisition of a reading result of the printed TP (step S200), and inspection of the nozzles 21 based on the reading result of the TP (step S300). Step S100 corresponds to a TP printing step. In FIG. 4, step S100 is illustrated in detail while being divided into steps S110 to S130.

At step S110, the printing control unit 12*a* acquires TP image data, which is image data representing the TP, from a storage source such as a predetermined memory or storage device with which the control unit 11 can communicate. The TP image data is, for example, image data in a bitmap format defining the color of each of pixels in a predetermined color system. As the color system referred to here, for example, there are various color systems, such as an RGB (red, green, blue) color system, a CMYK color system, or the like.

At step S120, the printing control unit 12*a* generates, from the TP image data, the print data for printing the TP. The printing control unit 12*a* generates the print data that prescribes ink discharge (dot on) or ink non-discharge (dot off) for each of the pixels and each of the ink colors, by performing predetermined image processing, such as color conversion processing and halftone processing, on the TP image data. As illustrated in FIG. 3, assuming that the printing head 18 uses the four colors of ink of CMYK, at step S120, the printing control unit 12*a* generates the print data prescribing the dot on and off for each of the pixels and for each of CMYK, based on the TP image data.

At step S130, by controlling the ink discharge by each of the nozzles 21 of the printing head 18, the printing control unit 12*a* prints the TP on the printing medium 30 on the basis of the print data.

The TP of the embodiment is configured to include a "main TP" and a "sub TP". The sub TP includes one or both of a "first sub TP" and a "second sub TP".

The main TP is a pattern in which a plurality of pattern elements printed by the nozzles 21 are arranged side by side in a first direction. Specifically, pattern element groups formed of the plurality of pattern elements arranged in cycles of N in the first direction are arranged so as to be shifted with respect to each other in a second direction intersecting the first direction, thus forming the main TP configured by N pattern element groups. With reference to FIG. 2 and FIG. 3, the transport direction D1 corresponds to the first direction, and the main scanning direction D2 corresponds to the second direction. N is an integer of 3 or greater. The main TP may be understood to be a pattern of a mode that is printed in known art for the inspection of the nozzles 21.

At step S130, in addition to the main TP, the printing control unit 12*a* causes the printing head 18 to print, on the printing medium 30, at least one of the first sub TP disposed in one region, of both of regions sandwiching the main TP in the second direction, and the second sub TP disposed in the other region of both the regions. The first sub TP is configured by pattern elements printed by the nozzle 21 that prints the pattern elements of the pattern element group (the N-th pattern element group) positioned furthest from the one region in the second direction, among the N pattern element groups of the main TP. On the other hand, the second sub TP is configured by pattern elements printed by the nozzle 21 that prints the pattern elements of the pattern element group (the first pattern element group) positioned furthest from the other region in the second direction, among the N pattern element groups of the main TP.

The printing control unit 12*a* may complete the printing of the TP at step S130 in a single pass of the printing head 18 or may complete the printing in a plurality of passes. In either case, the printing control unit 12*a* does not cause the transport unit 16 to transport the printing medium 30 during a period from a first pass to the end of a last pass for printing the TP at step S130.

Figure 5:
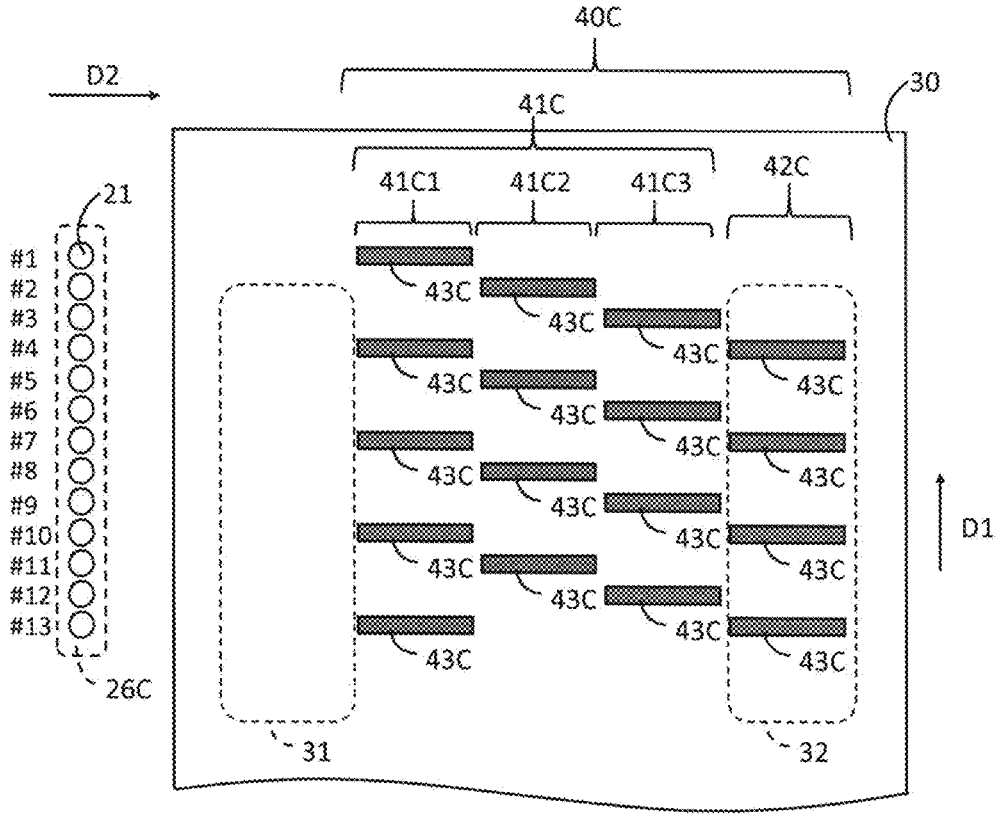
FIG. 5 is a diagram illustrating a portion of a TP according to a first example.

In FIG. 5, a portion of the nozzle row 26C used for printing a TP 40C, a portion of the printing medium 30, and a portion of the TP 40C printed on the printing medium 30 at step S130 are illustrated. The TP described using FIG. 5 is also referred to as the TP of a "first example". Note that FIG. 5, and FIG. 6 to FIG. 10 to be described later, all illustrate the TP when N is 3.

The C ink is discharged from each of the nozzles 21 of the nozzle row 26C by a pass of the printing head 18, and a plurality of pattern elements 43C are printed. Each of the pattern elements 43C is a ruled line parallel with the main scanning direction D2, formed by dots of the C ink discharged by one of the nozzles 21 in the nozzle row 26C. In FIG. 5, in order to distinguish the nozzles 21 in the nozzle row 26C, each of the nozzles 21 is assigned a nozzle number for convenience. Specifically, the nozzles 21 are numbered sequentially from downstream to upstream as nozzles #1, #2, #3, and so on. In FIG. 5, due to limitations of space on paper, thirteen of the nozzles 21 having the nozzle numbers #1 to #13 are illustrated, but of course, the nozzle row 26C is configured by more of the nozzles 21, and each of the nozzles 21 of the nozzle row 26C prints the pattern element 43C.

In a main TP 41C of the TP 40C, the plurality of pattern elements 43C printed by each of the nozzles 21 are ideally formed by being arranged at intervals corresponding to the nozzle pitch in the transport direction D1. Further, the main TP 41C is formed by a first pattern element group 41C1, a second pattern element group 41C2, and a third pattern element group 41C3. The third pattern element group 41C3 corresponds to the N-th pattern element group.

Each one of the pattern element groups in the main TP 41C is formed of the plurality of pattern elements 43C arranged in cycles of three in the transport direction D1. In the example illustrated in FIG. 5, the plurality of pattern elements 43C respectively printed by each of the nozzles 21 having the nozzle numbers #1, #4, #7, #10, and #13 form the first pattern element group 41C1. Similarly, in the example illustrated in FIG. 5, the plurality of pattern elements 43C respectively printed by each of the nozzles 21 having the nozzle numbers #2, #5, #8, and #11 form the second pattern element group 41C2, and the plurality of pattern elements 43C respectively printed by each of the nozzles 21 having the nozzle numbers #3, #6, #9, and #12 form the third pattern element group 41C3.

Respective positions, in the main scanning direction D2, of the plurality of pattern elements 43C forming the one pattern element group may be understood to match or substantially match each other. Positions of the first pattern element group 41C1, the second pattern element group 41C2, and the third pattern element group 41C3 are arranged so as to be shifted with respect to each other in the main scanning direction D2. In other words, the first pattern element group 41C1, the second pattern element group 41C2, and the third pattern element group 41C3 are arranged in this order along the main scanning direction D2.

Of both the regions on the printing medium 30 sandwiching the main TP 41C in the main scanning direction D2, the one region is referred to as a first region 31, and the other region is referred to as a second region 32. The first region 31 is a region adjacent to the first pattern element group 41C1 of the main TP 41C, and the second region 32 is a region adjacent to the third pattern element group 41C3 of the main TP 41C. In the example illustrated in FIG. 5, based on the positional relationship of the first pattern element group 41C1, the second pattern element group 41C2, and the third pattern element group 41C3, the region on the left side with respect to the main TP 41C is the first region 31, and the region on the right side with respect to the main TP 41C is the second region 32.

As can be understood from FIG. 5, the TP 40C according to the first example includes, in addition to the main TP 41C, a second sub TP 42C printed in the second region 32. The second sub TP 42C is configured by the pattern elements 43C in the same positions, in the transport direction D1, as the pattern elements 43C of the first pattern element group 41C1 furthest from the second region 32, among the three pattern element groups of the main TP 41C. The pattern elements 43C being in the same positions, in the transport direction D1, as the pattern elements 43C of the first pattern element group 41C means that the pattern elements 43C are printed by the same nozzles 21 used to print the first pattern element group 41C. As can be understood from FIG. 5, the pattern elements 43C forming the second sub TP 42C are respectively printed by each of the nozzles 21 having the nozzle numbers #4, #7, #10, and #13, which are used to print the first pattern element group 41C1. In other words, in the first example, the printing control unit 12*a* prints, in the second region 32, a pattern that is substantially the same as the first pattern element group 41C1 that is printed in the position furthest from the second region 32, among the respective pattern element groups of the main TP 41C.

Of course, at step S130, the printing head 18 also discharges the ink from the nozzle rows 26M, 26Y, and 26K as well as from the nozzle row 26C, and prints the TP for each of the ink colors on the printing medium 30 in the same manner as the printing of the TP 40C using the C ink.

Figure 6:
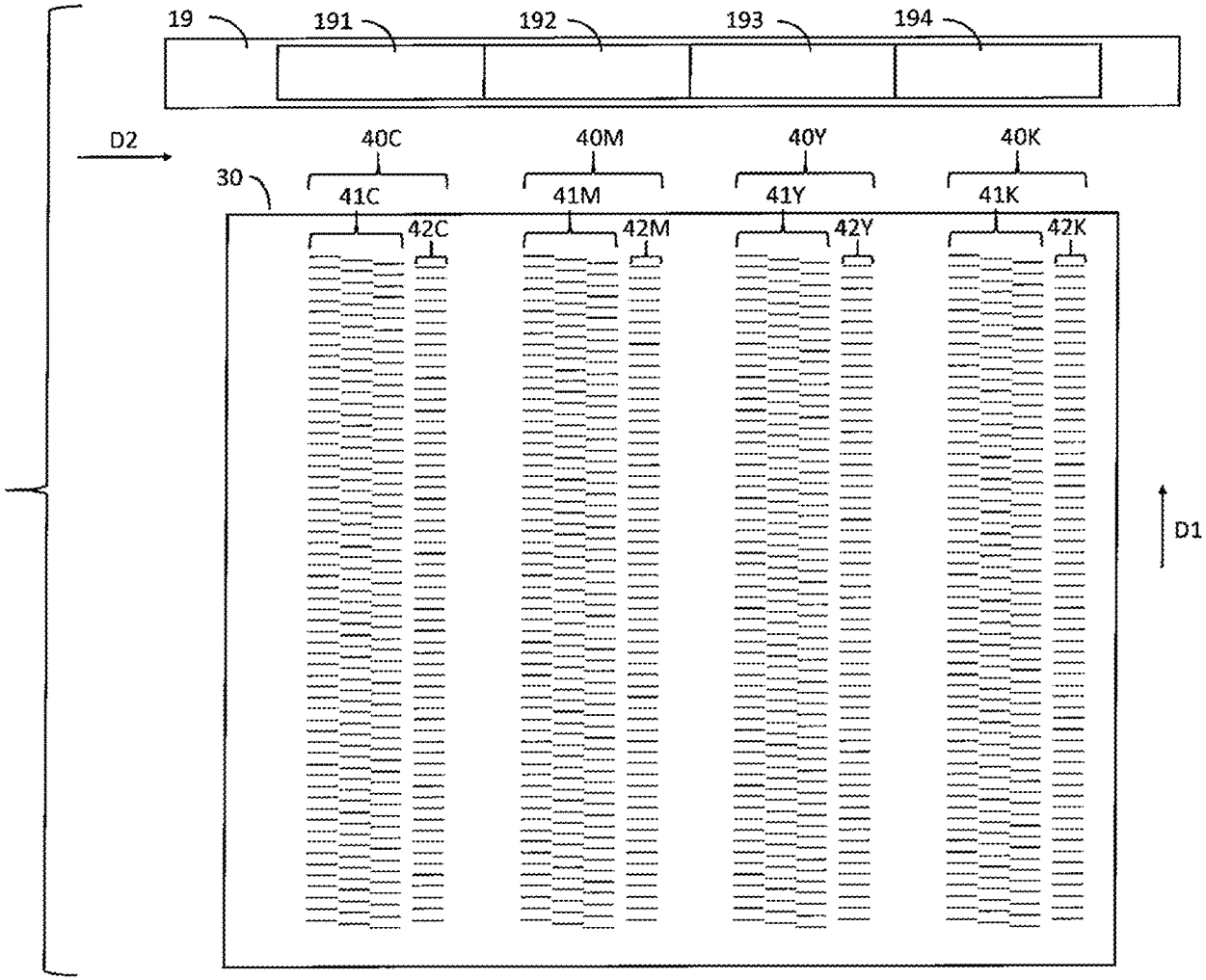
FIG. 6 is a diagram illustrating the printing medium or the like on which the TPs for each of ink colors are printed.

FIG. 6 illustrates the printing medium 30 on which the TP 40C, and TPs 40M, 40Y, and 40K are printed as a result of step S130. As described with reference to FIG. 5, the TP 40C is configured by the main TP 41C and the second sub TP 42C printed by each of the nozzles 21 of the nozzle row 26C discharging the C ink. Similarly, the TP 40M is configured by a main TP 41M and a second sub TP 42M printed by each of the nozzles 21 of the nozzle row 26M discharging the M ink. The TP 40Y is configured by a main TP 41Y and a second sub TP 42Y printed by each of the nozzles 21 of the nozzle row 26Y discharging the Y ink. The TP 40K is configured by a main TP 41K and a second sub TP 42K printed by each of the nozzles 21 of the nozzle row 26K discharging the K ink. In other words, the print data generated at step S120 is data representing the TP for each of the ink colors in this way.

The specific example of the TP according to the embodiment is not limited to the first example, and may be any of the following second to fourth examples.

Figure 7:
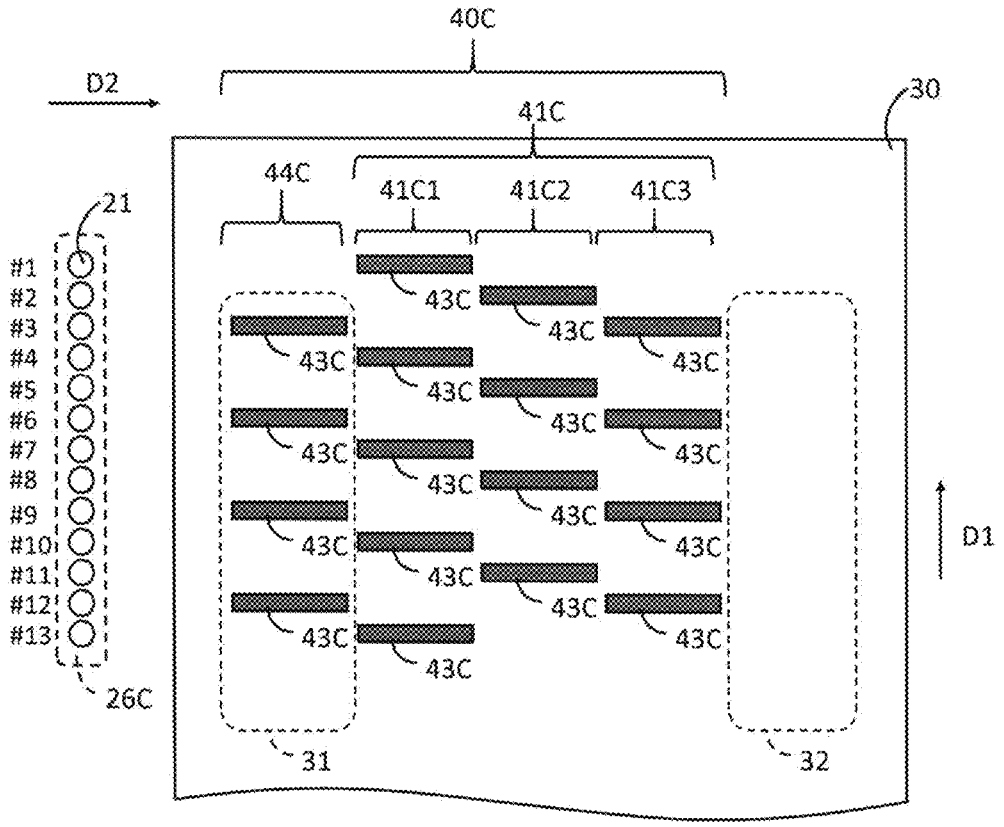
FIG. 7 is a diagram illustrating a portion of the TP according to a second example.
Figure 8:
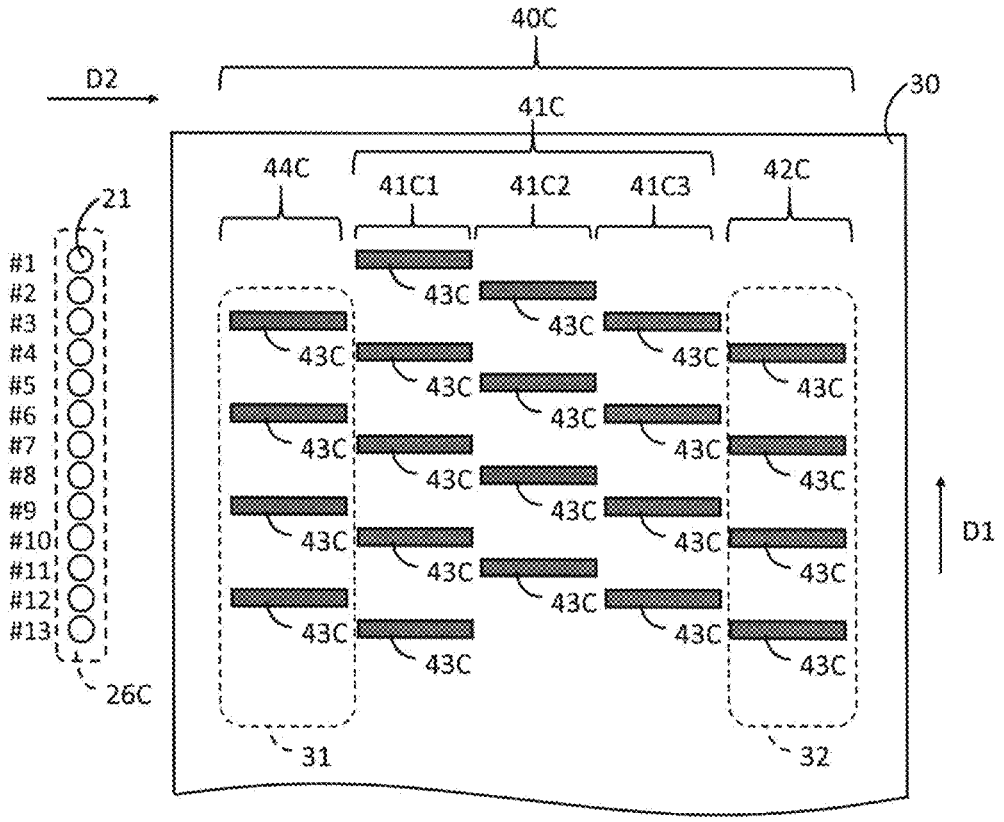
FIG. 8 is a diagram illustrating a portion of the TP according to a third example.
Figure 9:
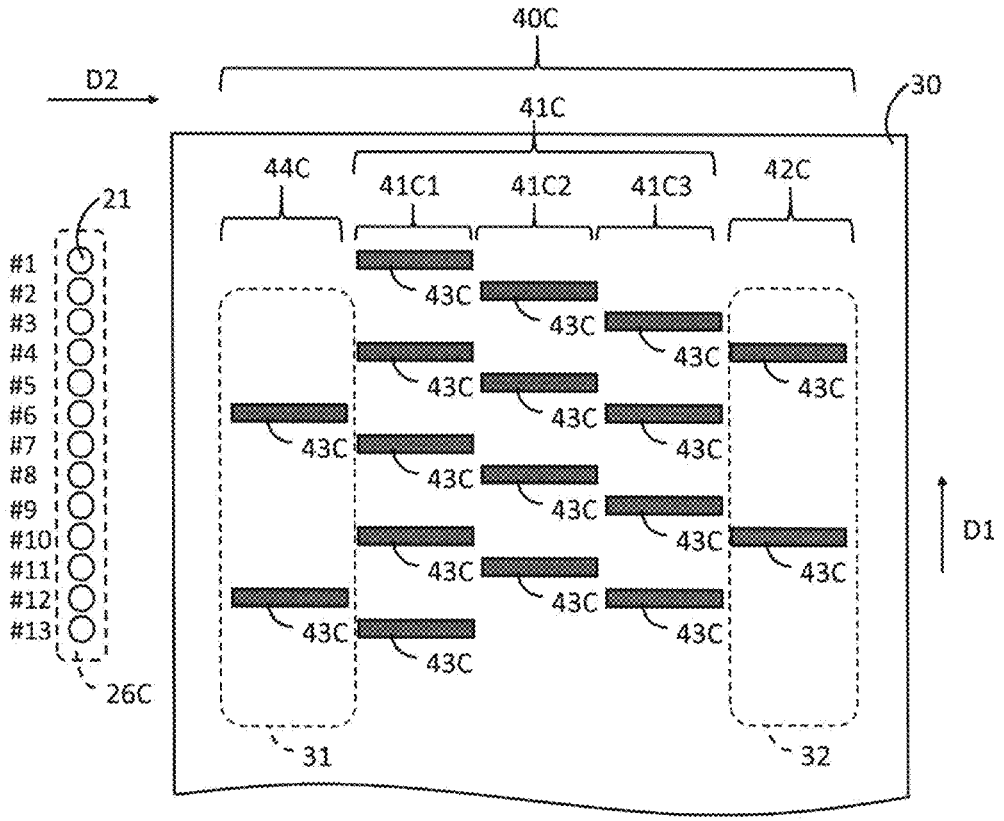
FIG. 9 is a diagram illustrating a portion of the TP according to a fourth example.

In each of FIG. 7, FIG. 8, and FIG. 9, a portion of the nozzle row 26C used for printing the TP 40C, a portion of the printing medium 30, and a portion of the TP 40C printed on the printing medium 30 at step S130 are illustrated. A direction of view in FIG. 7 to FIG. 9 is the same as that in FIG. 5.

The TP described using FIG. 7 is also referred to as the TP of the "second example", the TP illustrated in FIG. 8 is also referred to as the TP of the "third example", and the TP illustrated in FIG. 9 is also referred to as the TP of the "fourth example".

As can be understood from FIG. 7, the TP 40C according to the second example includes, in addition to the main TP 41C, a first sub TP 44C printed in the first region 31. The first TP 44C is configured by the pattern elements 43C in the same positions, in the transport direction D1, as the pattern elements 43C of the third pattern element group 41C3 furthest from the first region 31, among the three pattern element groups of the main TP 41C. The pattern elements 43C being in the same positions, in the transport direction D1, as the pattern elements 43C of the third pattern element group 41C3 means that the pattern elements 43C are printed by the same nozzles 21 used to print the third pattern element group 41C3. As can be understood from FIG. 7, the pattern elements 43C forming the first sub TP 44C are respectively printed by each of the nozzles 21 having the nozzle numbers #3, #6, #9, and #12, which are used to print the third pattern element group 41C3. In other words, in the second example, the printing control unit 12*a* prints, in the first region 31, a pattern that is substantially the same as the third pattern element group 41C3 that is printed in the position furthest away from the first region 31, among the respective pattern element groups of the main TP 41C.

As illustrated in FIG. 8, the TP 40C according to the third example includes, in addition to the main TP 41C, the first sub TP 44C printed in the first region 31 and the second sub TP 42C printed in the second region 32.

As described above, according to the first to third examples, only one of the first sub TP and the second sub TP may be printed as the sub TP to be printed along with the main TP, or both may be printed.

The TP 40C according to the fourth example illustrated in FIG. 9 can be said to be a modified example of the third example, in which some of the pattern elements 43C of the first sub TP 44C and some of the pattern elements 43C of the second sub TP 42C are randomly printed in the first region 31 and the second region 32. The pattern elements 43C of the first region 31 and the pattern elements 43C of the second region 32 can be said to be the pattern elements for ensuring that, between the first pattern element group 41C1 and the third pattern element group 41C3 that are in the separated relationship in the main scanning direction D2, a comparison between the pattern elements having the continuous nozzle numbers can be performed at close range. In the TP 40C according to the fourth example, based on a concept that it is sufficient that such a comparison be able to be performed using either one of the first region 31 and the second region 32, the pattern elements 43C of the first sub TP 44C and the second sub TP 42C are disposed in a smaller number than in the third example.

3. Processing After Printing Test Pattern

At step S200, the reading control unit 12*b* controls the reading unit 19 to read the printing medium 30 on which the TP has been printed at step S100, and acquires read image data that is image data from the reading unit 19 as a reading result. It goes without saying that the transport unit 16 performs the transport necessary for the reading unit 19 to read the printing medium 30 after the printing.

In FIG. 6, the reading unit 19 is illustrated downstream of the printing medium 30. When the printing medium 30 transported downstream by the transport unit 16 passes below the reading unit 19, the printing medium 30 is read by the reading unit 19. In the example illustrated in FIG. 6, the reading unit 19 is configured by a plurality of sensor chips 191, 192, 193, and 194 being coupled in the main scanning direction D2. Each of the plurality of sensor chips 191, 192, 193, and 194 includes an image sensor, and reads a predetermined range of the transported printing medium 30.

Note that, at step S200, it is sufficient that the reading result of the printing medium 30 on which the TP has been printed can be acquired. Thus, the user may cause an external scanner to read the printing medium 30 on which the TP has been printed, and the printing apparatus 10 may acquire read image data from the scanner, via the communication IF 15.

At step S300, the inspection unit 12*c* inspects a state of the ink discharge by the nozzles 21 of the printing head 18, based on the read image data acquired at step S200. The state of the ink discharge is divided into normal and abnormal. Abnormal applies to a discharge failure, such as a landing position deviation in which the landing positions of the dots deviate from ideal landing positions, and the like. From the read image data, it is sufficient that the inspection unit 12*c* detects each of the pattern elements forming the main TP, and compares the interval (hereinafter, a pattern element pitch) in the transport direction D1 between the pattern elements used in the printing that have the continuous nozzle numbers, with a predetermined reference value relating to the pattern element pitch. For example, it is sufficient that the inspection unit 12*c* determine the abnormality for the nozzle 21 associated with the printing in which the pattern element pitch is narrower or wider than the reference value. The inspection unit 12*c* performs the inspection for each of the ink colors and each of the nozzles 21 on the basis of the read image data, and stores the test results as data.

Note that, for the pattern element pitch to be detected between the pattern elements of the N-th pattern element group and the pattern elements of the first pattern element group, the inspection unit 12*c* performs the detection using the pattern elements of the sub TP in place of the pattern elements of either the N-th or the first pattern element group.

In other words, when the pattern elements 43C of the third pattern element group 41C3 of the main TP 41C, and the pattern elements 43C of the second sub TP 42C respectively corresponding to the nozzle numbers immediately subsequent to the nozzle numbers corresponding to the pattern elements 43C of the third pattern element group 41C3 are printed, it is sufficient that the inspection unit 12*c* detects, from the read image data, the pattern element pitch between these two pattern elements 43C, and compares the pattern element pitch to the reference value. Further, when the pattern elements 43C of the first pattern element group 41C1 of the main TP 41C, and the pattern elements 43C of the first sub TP 44C respectively corresponding to the nozzle numbers immediately preceding the nozzle numbers corresponding to the pattern elements 43C of the first pattern element group 41C1 are printed, it is sufficient that the inspection unit 12*c* detects, from the read image data, the pattern element pitch between these two pattern elements 43C, and compares the pattern element pitch to the reference value.

The significance of using the pattern elements of the sub TP for the inspection at step S300 will be described with reference to FIG. 10.

Figure 10:
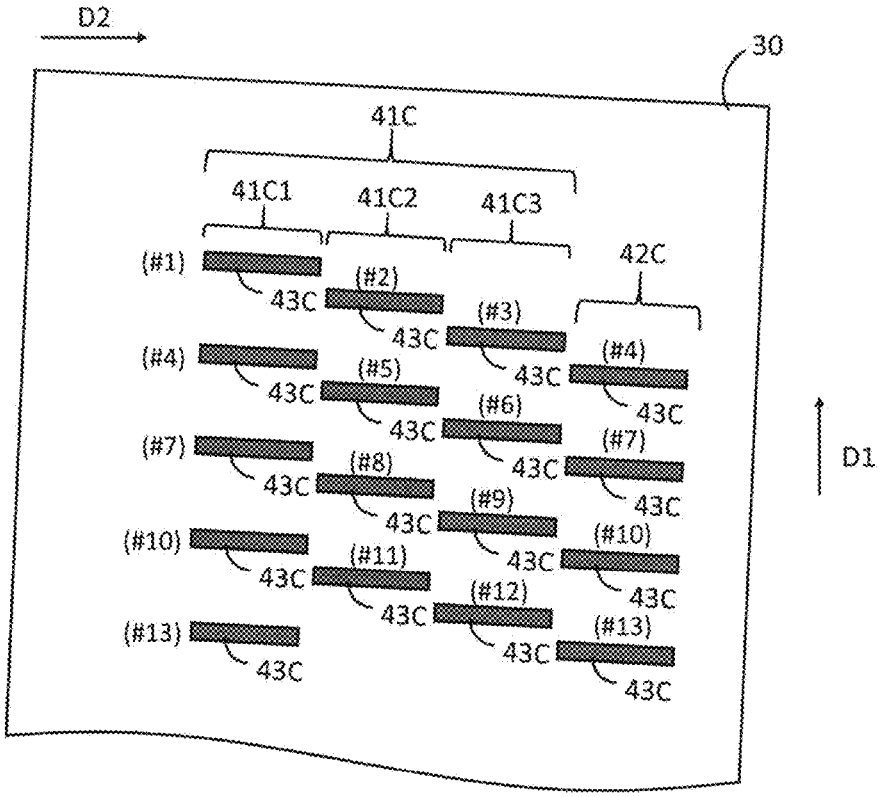
FIG. 10 is a diagram illustrating the printing medium, on which the TP is printed, in a skewed state.

FIG. 10 illustrates a portion of the printing medium 30 on which the TP has been printed at step S100. In FIG. 10, the TP according to the first example described using FIG. 5 is printed. Further, the printing medium 30 illustrated in FIG. 10 is tilted slightly to the right with respect to the transport direction D1. The printing medium 30 being tilted is also referred to as being skewed. In FIG. 10, for ease of understanding, for each of the pattern elements 43C, the nozzle number of the nozzle 21 used for the printing is noted in parentheses. Further, the pattern element printed by the nozzle 21 having the nozzle number #n is simply referred to as the pattern element having the nozzle number #n. n is an integer of 1 or greater.

Here, a case will be described as an example in which the pattern element pitch is detected for the pattern element 43C having the nozzle number #3 and the pattern element 43C having the nozzle number #4.

In a situation in which the TP of known art, that is, the main TP 41C only is printed, from the read image data, it is necessary to detect the pattern element pitch between the pattern elements 43C having the nozzle number #3 in the third pattern element group 41C3 and the pattern elements 43C having the nozzle number #4 in the first pattern element group 41C1. However, when the printing medium 30, on which the TP is printed, is read by the reading unit 19 or the like while being in the skewed state, as illustrated in FIG. 10, due to a transport failure, for example, it is difficult to accurately detect the pattern element pitch between the pattern elements in the positional relationship of being separated from each other in the main scanning direction D2 in this way.

In the example illustrated in FIG. 10, when the pattern element pitch between the pattern element 43C having the nozzle number #3 in the third pattern element group 41C3 and the pattern element 43C having the nozzle number #4 in the first pattern element group 41C1 is detected, a narrower interval is detected than the pattern element pitch in an original state, that is, when there is no skew. Further, when the printing medium 30 is skewed to the left with respect to the transport direction D1, when the pattern element pitch between the pattern element 43C having the nozzle number #3 in the third pattern element group 41C3 and the pattern element 43C having the nozzle number #4 in the first pattern element group 41C1 is detected, a wider interval is detected than the original pattern element pitch.

In contrast, in the embodiment, when detecting the pattern element pitch between the pattern element 43C having the nozzle number #3 and the pattern element 43C having the nozzle number #4, from the read image data, it is possible to detect the pattern element pitch between the pattern element 43C having the nozzle number #3 in the third pattern element group 41C3 and the pattern element 43C having the nozzle number #4 in the second sub TP 42C. The pattern element 43C having the nozzle number #3 in the third pattern element group 41C3 and the pattern element 43C having the nozzle number #4 in the second sub TP 42C are adjacent in the main scanning direction D2. Thus, even in the skewed state as illustrated in FIG. 10, an interval substantially similar to the original pattern element pitch is detected. Thus, the inspection unit 12*c* can detect the accurate pattern element pitch that eliminates the effect of the skew and can inspect the nozzles 21.

Note that, when the printing control unit 12*a* has printed the TP of the third example, using the respective relationships between the third pattern element group 41C3 and the second sub TP 42C and the first pattern element group 41C1 and the first sub TP 44C, the inspection unit 12*c* can detect, from the read image data, the pattern element pitch of a combination of common nozzle numbers (a combination of the nozzle numbers #3 and #4, for example). In this case, the inspection unit 12*c* may take an average value, of two values detected as the pattern element pitches between the pattern elements 43C according to the combination of the nozzle numbers #3 and #4, as the pattern element pitch between the pattern elements 43C according to the combination of the nozzle numbers #3 and #4.

Further, the inspection unit 12*c* may perform tilt correction on the acquired read image data by rotating the image to reduce the effect of the skew, and may then detect the pattern element pitch. Even when such tilt correction is performed, it is possible to more accurately detect the pattern element pitch in the printing result of the TP when the pattern elements of the first sub TP and the pattern elements of the second sub TP are used to detect some of the pattern element pitches, as in the embodiment.

4. Summary and Description of Effects

According to the embodiment, as described above, the printing apparatus 10 is provided with the printing head 18 including the plurality of nozzles 21 that discharge the ink, and the control unit 11 that, by controlling the printing head 18, causes the TP to be printed on the printing medium 30 for the inspection of the state of the ink discharge by the nozzles 21. The TP includes the main TP formed by the N pattern element groups in which the plurality of pattern elements printed by the nozzles are arranged in the first direction, the pattern element groups being formed of the plurality of pattern elements disposed in the cycles of N in the first direction, and the pattern element groups being disposed in positions shifted with respect to each other in the second direction intersecting the first direction. Note that N is an integer of 3 or greater.

Then, as the TP, the control unit 11 causes the printing head 18 to print, on the printing medium 30, the main TP and at least one of the first sub TP disposed in the one region of both the regions sandwiching the main TP in the second direction, and the second sub TP disposed in the other region of both the regions. The first sub TP is configured by the pattern elements printed by the nozzles 21 used to print the pattern elements of the pattern element group positioned furthest away from the one region, in the second direction, among the N pattern element groups. The second sub TP is configured by the pattern elements printed by the nozzles 21 used to print the pattern elements of the pattern element group positioned furthest away from the other region, in the second direction, among the N pattern element groups.

According to the configuration described above, the control unit 11 prints at least one of the first sub TP and the second sub TP on the printing medium 30 along with the main TP. In this way, even if the printing medium 30 is read in a skewed state, it is possible to provide the TP with which the inspection of the nozzles 21 is appropriately performed by eliminating inaccuracy of the pattern element pitch detection caused by the skew.

According to the embodiment, the printing apparatus 10 may include the reading unit 19 provided at a position downstream of the printing head 18 in the transport direction D1, and configured to read the printing medium 30 printed with the TP, the transport direction D1 of the printing medium being the first direction. Further, in the example illustrated in FIG. 6, the reading unit 19 includes the plurality of sensor chips including the image sensors for reading.

Then, the main TP and at least one of the first sub TP and the second sub TP configuring the TP may be disposed in positions readable by the same sensor chip.

In the example illustrated in FIG. 6, the TP 40C formed by the main TP 41C and the second sub TP 42C is printed at a position, on the printing medium 30, that is read by the sensor chip 191. Further, in the example illustrated in FIG. 6, on the printing medium 30, the TP 40M is printed at a position that is read by a sensor chip 192, the TP 40Y is printed at a position that is read by a sensor chip 193, and the TP 40K is printed at a position that is read by a sensor chip 194. Since each of the sensor chips has unique output characteristics and there is a deviation in mutual installation positions thereof, there may be deviations in color or position between read values output by each of the sensor chips. As in the example illustrated in FIG. 6, since the main TP and the sub TP configuring the TP are in the positional relationship of being read by the same sensor chip, various types of deviation caused by differences in the sensor chips do not occur between a read value of the main TP and a read value of the sub TP and accuracy of the detection of the pattern element pitch based on the read value of the main TP and the read value of the sub TP is improved.

The embodiment also discloses an invention of each of categories, such as a method other than the printing apparatus 10 and the printing system 10, and the program 12.

A printing method includes a printing step of controlling the printing head 18 including the plurality of nozzles 21 configured to discharge the ink, to print, on the printing medium 30, the TP for inspecting the state of the ink discharge by the nozzles 21. The TP includes the main TP formed by the N pattern element groups in which the plurality of pattern elements printed by the nozzles are aligned in the first direction, the pattern element groups being formed of the plurality of pattern elements disposed in the cycles of N in the first direction, and the pattern element groups being disposed in positions shifted with respect to each other in the second direction intersecting the first direction. Note that N is an integer of 3 or greater.

Then, as the TP, the printing step causes the printing head 18 to print the main TP and at least one of the first sub TP disposed in the one region of both the regions sandwiching the main TP in the second direction, and the second sub TP disposed in the other region of both the regions. The first sub TP is configured by the pattern elements printed by the nozzles 21 used to print the pattern elements of the pattern element group positioned furthest away from the one region, in the second direction, among the N pattern element groups. The second sub TP is configured by the pattern elements printed by the nozzles 21 used to print the pattern elements of the pattern element group positioned furthest away from the other region, in the second direction, among the N pattern element groups.

5. Other Embodiments

Other aspects included in the embodiment will be described.

It goes without saying that the printing medium 30 need not necessarily be the continuous sheet wound into the roll, as exemplified in FIG. 2, or the like. The printing medium 30 may be a single sheet cut into page units, or the like.

Further, N may be an integer greater than 3. Since, in the configuration of the TP of known art, the harmful effect on the pattern element pitch detection due to the influence of the skew is larger the greater the value of N, that is, the greater the number of the pattern element groups configuring the main TP, the more effective the embodiment can be said to be the greater the value of N.

The printing apparatus 10 need not necessarily be the so-called serial inkjet printer in which the printing head 18 is mounted on the carriage 17 that moves in the main scanning direction D2 as described above.

A so-called line type inkjet printer can also be envisaged that discharges the ink using the printing head 18 extending in the main scanning direction D2 intersecting the transport direction D1, having a length able to cover the width of the printing medium 30, and including the nozzle rows 26 for each of the ink colors. In the line type inkjet printer, the nozzle row direction D3 may be understood to be parallel with the main scanning direction D2 rather than the transport direction D1. When describing the embodiment assuming that the printing apparatus 10 is the line type inkjet printer, the TP is printed on the printing medium 30 having an orientation in which each of the pattern elements, which is the ruled line, is parallel to the transport direction D1, rather than the main scanning direction D2. In other words, the main scanning direction D2 may be defined as the first direction, and the transport direction D1 may be defined as the second direction.

The arrangement of the reading unit 19 need not necessarily be downstream of the printing medium 30, and may be upstream of the printing medium 30.

The reading unit 19 need not necessarily be a fixed line scan type, and may be, for example, a mobile serial scan type in which the reading unit 19 performs the reading while moving in the main scanning direction D2.

Each of the pattern elements 43C need not necessarily be the ruled line and may be, for example, a point.

What is claimed is:

1. A printing apparatus comprising:

a printing head including a plurality of nozzles configured to discharge ink; and a control unit configured to control the printing head to print, on a printing medium, a test pattern for inspecting a state of ink discharge by the nozzles, wherein N is an integer of 3 or greater, the test pattern includes a main test pattern in which a plurality of pattern elements printed by the nozzles are arranged in a first direction, the main test pattern being formed by N pattern element groups, the main test pattern including the pattern element groups disposed in positions shifted with respect to each other in a second direction intersecting the first direction, the pattern element groups being formed of the plurality of pattern elements disposed in cycles of N in the first direction, and at least one of a first sub test pattern and a second sub test pattern, the first sub test pattern being disposed in one of two regions sandwiching the main test pattern in the second direction, and the second sub test pattern being disposed in the other of the two regions, the first sub test pattern is configured by pattern elements printed by the nozzles used to print the pattern elements of the pattern element group positioned furthest away from the one region, in the second direction, among the N pattern element groups, and the second sub test pattern is configured by pattern elements printed by the nozzles used to print the pattern elements of the pattern element group positioned furthest away from the other region, in the second direction, among the N pattern element groups.

2. The printing apparatus according to claim 1, comprising:

at a position downstream of the printing head in a transport direction of the printing medium, a reading unit configured to read the printing medium printed with the test pattern, the transport direction of the printing medium being the first direction, wherein the reading unit includes a plurality of sensor chips including an image sensor for reading, and the main test pattern and at least one of the first sub test pattern and the second sub test pattern configuring the test pattern are disposed in positions readable by the same sensor chip.

3. A printing method comprising:

a printing step of controlling a printing head including a plurality of nozzles configured to discharge ink, to print, on a printing medium, a test pattern for inspecting a state of ink discharge by the nozzles, wherein N is an integer of 3 or greater, the test pattern includes a main test pattern in which a plurality of pattern elements printed by the nozzles are arranged in a first direction, the main test pattern being formed by N pattern element groups, the main test pattern including the pattern element groups disposed in positions shifted with respect to each other in a second direction intersecting the first direction, the pattern element groups being formed of the plurality of pattern elements disposed in cycles of N in the first direction, and at least one of a first sub test pattern and a second sub test pattern, the first sub test pattern being disposed in one of two regions sandwiching the main test pattern in the second direction, and the second sub test pattern being disposed in the other of the two regions, the first sub test pattern is configured by pattern elements printed by the nozzles used to print the pattern elements of the pattern element group positioned furthest away from the one region, in the second direction, among the N pattern element groups, and the second sub test pattern is configured by pattern elements printed by the nozzles used to print the pattern elements of the pattern element group positioned furthest away from the other region, in the second direction, among the N pattern element groups.

* * * * *